US010787884B2

(12) United States Patent
Brandsdal

(10) Patent No.: US 10,787,884 B2
(45) Date of Patent: Sep. 29, 2020

(54) DOWNHOLE TOOL HAVING A DISSOLVABLE PLUG

(71) Applicant: FRAC TECHNOLOGY AS, Ytre Arna (NO)

(72) Inventor: Viggo Brandsdal, Ytre Arna (NO)

(73) Assignee: FRAC Technology AS (NO)

( * ) Notice: Subject to any disclaimer, the term of this patent is extended or adjusted under 35 U.S.C. 154(b) by 154 days.

(21) Appl. No.: 15/977,811

(22) Filed: May 11, 2018

(65) Prior Publication Data

US 2018/0334882 A1 Nov. 22, 2018

(30) Foreign Application Priority Data

May 19, 2017 (NO) ..... 20170824

(51) Int. Cl.

| | |
|---|---|
| ***E21B 34/14*** | (2006.01) |
| ***E21B 34/10*** | (2006.01) |
| ***E21B 34/06*** | (2006.01) |
| ***E21B 33/12*** | (2006.01) |

(52) U.S. Cl.

CPC ..... *E21B 34/063* (2013.01); *E21B 33/1208* (2013.01); *E21B 34/10* (2013.01); *E21B 2200/06* (2020.05)

(58) Field of Classification Search

CPC ..... E21B 34/14; E21B 34/063; E21B 34/10
See application file for complete search history.

(56) References Cited

U.S. PATENT DOCUMENTS

| | | | | |
|---|---|---|---|---|
| 5,607,017 | A * | 3/1997 | Owens | E21B 33/12 166/288 |
| 7,726,406 | B2 * | 6/2010 | Xu | E21B 23/00 166/376 |
| 8,276,670 | B2 * | 10/2012 | Patel | E21B 33/1208 166/188 |
| 9,359,864 | B2 * | 6/2016 | Harris | E21B 34/101 |
| 9,476,282 | B2 | 10/2016 | Anton et al. | |
| 9,816,350 | B2 * | 11/2017 | Mailand | E21B 34/125 |
| 10,337,285 | B2 * | 7/2019 | Kellner | E21B 34/10 |
| 2014/0318780 | A1 * | 10/2014 | Howard | E21B 23/06 166/285 |

(Continued)

FOREIGN PATENT DOCUMENTS

WO WO 2015/130258 A1 9/2015

OTHER PUBLICATIONS

Norwegian Search Report issued in Norwegian Patent Application No. 20170824 dated Dec. 19, 2017.

*Primary Examiner* — Kenneth L Thompson
(74) *Attorney, Agent, or Firm* — Vinson & Elkins L.L.P.

(57) ABSTRACT

A downhole valve having: a valve body with a longitudinal main passage; an annular chamber arranged in the valve body; at least one valve port extending from the main passage, through the annular chamber and to an outside of the valve. The downhole valve further includes a sleeve disposed at least partially within the chamber. The sleeve is movable in response to an application of fluid pressure to the annular chamber via a fluid channel extending from the main passage to the annular chamber. The sleeve is movable between a closed position in which the sleeve blocks the at least one valve port and an open position in which the sleeve does not block the at least one valve port.

23 Claims, 11 Drawing Sheets

(56) References Cited

U.S. PATENT DOCUMENTS

| | | | | |
|---|---|---|---|---|
| 2014/0338923 | A1* | 11/2014 | Fripp | E21B 34/063 166/376 |
| 2014/0374096 | A1 | 12/2014 | Anton et al. | |
| 2015/0129205 | A1* | 5/2015 | Hofman | E21B 34/063 166/250.01 |
| 2015/0226031 | A1* | 8/2015 | Hekelaar | E21B 34/10 166/298 |
| 2015/0315873 | A1 | 11/2015 | Mailand et al. | |
| 2017/0037704 | A1* | 2/2017 | Nichols | E21B 34/10 |
| 2019/0136664 | A1* | 5/2019 | Roessler | E21B 17/046 |

* cited by examiner (a)

(b)

DOWNHOLE TOOL HAVING A DISSOLVABLE PLUG

CLAIM OF PRIORITY

This application claims priority to Norwegian Patent Application No. 20170824, filed May 19, 2017. The disclosure of the priority application is hereby incorporated in its entirety by reference.

The present invention relates to a downhole tool, and more particularly to a valve tool suitable for use in well completion and/or hydraulic fracturing operations.

BACKGROUND

When completing a petroleum well, i.e. preparing it for production, it is common to install one or more tubulars, such as casing, into the wellbore and cement the tubular in place. Such cementing operations include pumping cement down into the well through the tubular and causing it to flow upwardly and fill an annulus space between the tubular and the wellbore. When the required volume of cement has been pumped down into the well, the tubular is frequently "wiped", by pumping a wiper device down through the tubular. The wiper device may be, for example, a wiper dart.

After cementing, the well needs to be openend for production. This is commonly done using a so-called "toe valve". The toe valve may be pressure-activated, i.e. be activated through pressurizing of the tubular. U.S. Pat. No. 9,476,282 B2 describes an example of such a toe valve, in which a valve sleeve is arranged in a chamber defined by a first sub, a second sub and a housing. A pressure barrier, such as a rupture disc, is used to control the activation of the toe valve.

Such valves are subjected to challenging downhole conditions prior to their activation. This includes exposure to high pressures and temperatures, various well fluids, as well as to the cement during the cementing operation. It can therefore be a challenge to ensure that the toe valve activates properly and at the desired time. It is also desirable that such valves provide high integrity and operational safety of the well, and, for example, allow pressure testing of the well during or after completion, for example after the cementing operation. There is therefore a continuous need for improved solutions and techniques in relation to such valves and such completion operations.

The present invention has the objective to provide an improved tool for use in well completion and fracturing operation, which provide advantages over known solutions and techniques in reliability, operational safety or other aspects.

SUMMARY

In an embodiment, there is provided a downhole valve having: a valve body with a longitudinal main passage; an annular chamber arranged in the valve body; at least one valve port extending from the main passage, through the annular chamber and to an outside of the valve; and a sleeve disposed at least partially within the chamber, the sleeve being movable in response to an application of fluid pressure to the annular chamber via a fluid channel extending from the main passage to the annular chamber between a closed position in which the sleeve blocks the at least one valve port and an open position in which the sleeve does not block the at least one valve port.

In an embodiment, there is provided a downhole tool having: a body;

an activation element arranged within the body; a fluid channel extending from an opening in the body to the activation element; at least one dissolvable plug sealingly arranged in the fluid channel; and at least one breakable fluid barrier sealingly arranged in the fluid channel.

In an embodiment, there is provided a tubular assembly for use in a wellbore, the tubular assembly comprising a first downhole tool and a second downhole tool, wherein the first downhole tool has a higher number of dissolvable plugs and a higher number of breakable fluid barriers than the second downhole tool.

In an embodiment, there is provided a method of completing a well, comprising the steps of: deploying a tubular comprising a downhole valve into a wellbore; pumping cement through the tubular and into an annulus between the tubular and a formation; causing a dissolvable plug to degrade, disintegrate or dissolve; actuating a valve by applying a fluid pressure to the annular chamber via a fluid channel; and flowing a fluid through at least one valve port.

Further embodiments are set out in the following detailed description and in the appended claims.

BRIEF DESCRIPTION OF THE DRAWINGS

Illustrative embodiments of the present invention will now be described with reference to the appended drawings, in which.

DETAILED DESCRIPTION

Figure 1:
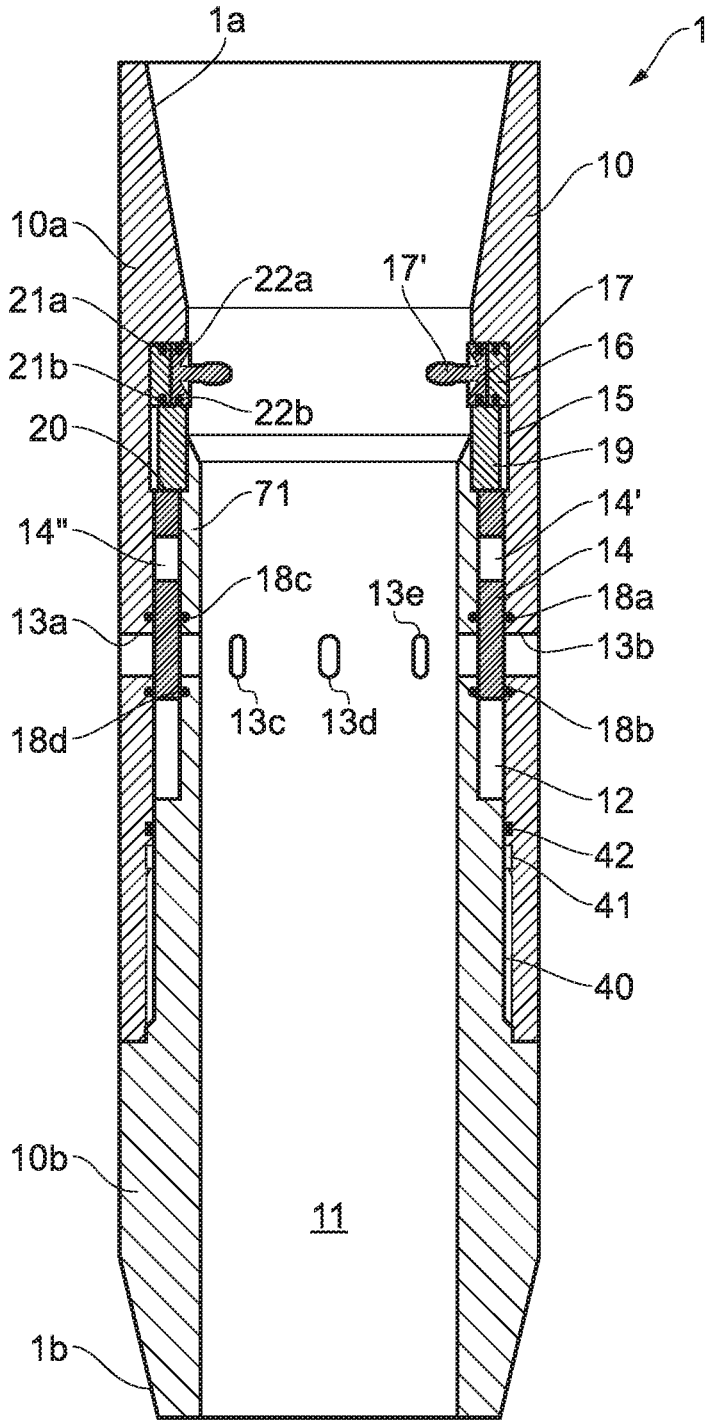
FIG. 1 illustrates a valve according to an embodiment.

In an embodiment, illustrated in FIG. 1, a downhole valve 1 is provided. The valve 1 has a body 10 with a longitudinal main passage 11, and is arranged for connection to a tubular pipe, such as a well tubing or a well casing (not shown) at end sections 1*a* and 1*b*. The valve body 10 is made up of a first sub 10*a* defining a first part of the main passage 11 and a second sub 10*b* defining a second part of the main passage 11. The first sub 10*a* and the second sub 10*b* are mechanically connected with a threaded connection 40. Suitable seals and packers 41,42 are arranged between the first sub 10*a* and the second sub 10*b*.

An annular chamber 12 is defined in the valve 1, in the embodiment shown here the annular chamber 12 is provided radially between sections of the first sub 10*a* and the second sub 10*b*. The second sub 10*b* comprises a protruding portion 71 extending into the first sub 10*a* and the annular chamber 12 is provided between an outside of the protruding portion 71 and an inner circumference of the first sub 10*a*. A plurality of ports 13*a-e* extend radially through the valve body 10, in this embodiment through the protruding portion 71 and the circumferential wall of the first sub 10*a*, between the main passage 11 and an outside of the valve 1. The annular chamber 12 is arranged so that the ports 13*a-e* extend through the annular chamber 12.

An annular sleeve 14 is disposed at least partially within the chamber 12, the sleeve 14 being movable axially (in relation to the longitudinal axis of the valve 1) between a closed position in which the sleeve 14 blocks the valve ports 13*a-e* and an open position in which the sleeve 14 does not block the valve ports 13*a-e*. In FIG. 1, the sleeve 14 is shown in the closed position. Appropriate seals 18*a-d* are provided to seal between the chamber 12 walls and the sleeve 14 such that a fluid tight sealing can be obtained between the main passage 11 and the outside of the valve 1 in the closed position. In the embodiment shown, the sleeve 14 comprises radial openings 14', 14" corresponding to the ports 13*a-e*, such that in the open position the openings 14',14" are aligned with the ports 13*a-e*.

A fluid channel 15 extends between the main passage 11 and the annular chamber 12. In the embodiment shown, the fluid channel 15 extends radially from the main passage 11 into a recess in the first sub 10*a*, past a packer element 19 and to the chamber 12. Through the fluid channel 15, a pressure in the main passage 11 can be made to act on a pressure face 20 of the sleeve 14, such as to move the sleeve from the closed position to the open position.

A dissolvable plug 16 is sealingly arranged in the fluid channel 15. When in place and intact, the dissolvable plug 16 thus prevents fluid communication between the main passage 11 and the chamber 12 and thus also the pressure face 20 of the sleeve 14. Suitable seals 21*a,b* are provided for this purpose. The dissolvable plug 16 is made from a degradable material which is reactive to water or well fluids. Well fluids may be, for example, water, hydrocarbons in liquid or gaseous form, drilling mud, etc. The degradable material may be, for example, an aluminium alloy, an aluminium-copper alloy, magnesium alloy or other well fluid degradable alloy. In the embodiment shown, the degradable material is AlGa. It is common in the industry to use degradable frac balls made of for instance aluminum alloys, magnesium alloys or zinc alloys that will dissolve in the well fluids. Any material currently used for such dissolvable frac balls may be relevant for use in embodiments of the present invention. The differences in metal alloy compositions is virtually unlimited and may be selected such as to provide a desired degradation speed. Non-metallic materials that dissolve in well fluids or water can also be used.

A protective element 17 is further arranged in the fluid channel 15. The protective element 17 is arranged to isolate the dissolvable plug 16 from the main passage 11. In the embodiment shown in FIG. 1, the protective element 17 is a plug 17 comprising glass, ceramic or a different type of brittle material. The protective plug 17 is sealingly arranged in the fluid channel 15 between the main passage 11 and the dissolvable plug 16. Seals 22*a,b* are provided to fluidly seal between the walls defining the fluid channel 15 and the protective plug 17. In the embodiment shown in FIG. 1, a part 17' of the protective element 17 protrudes into the main passage 11. The purpose of this protruding part will be described below.

Figure 2:
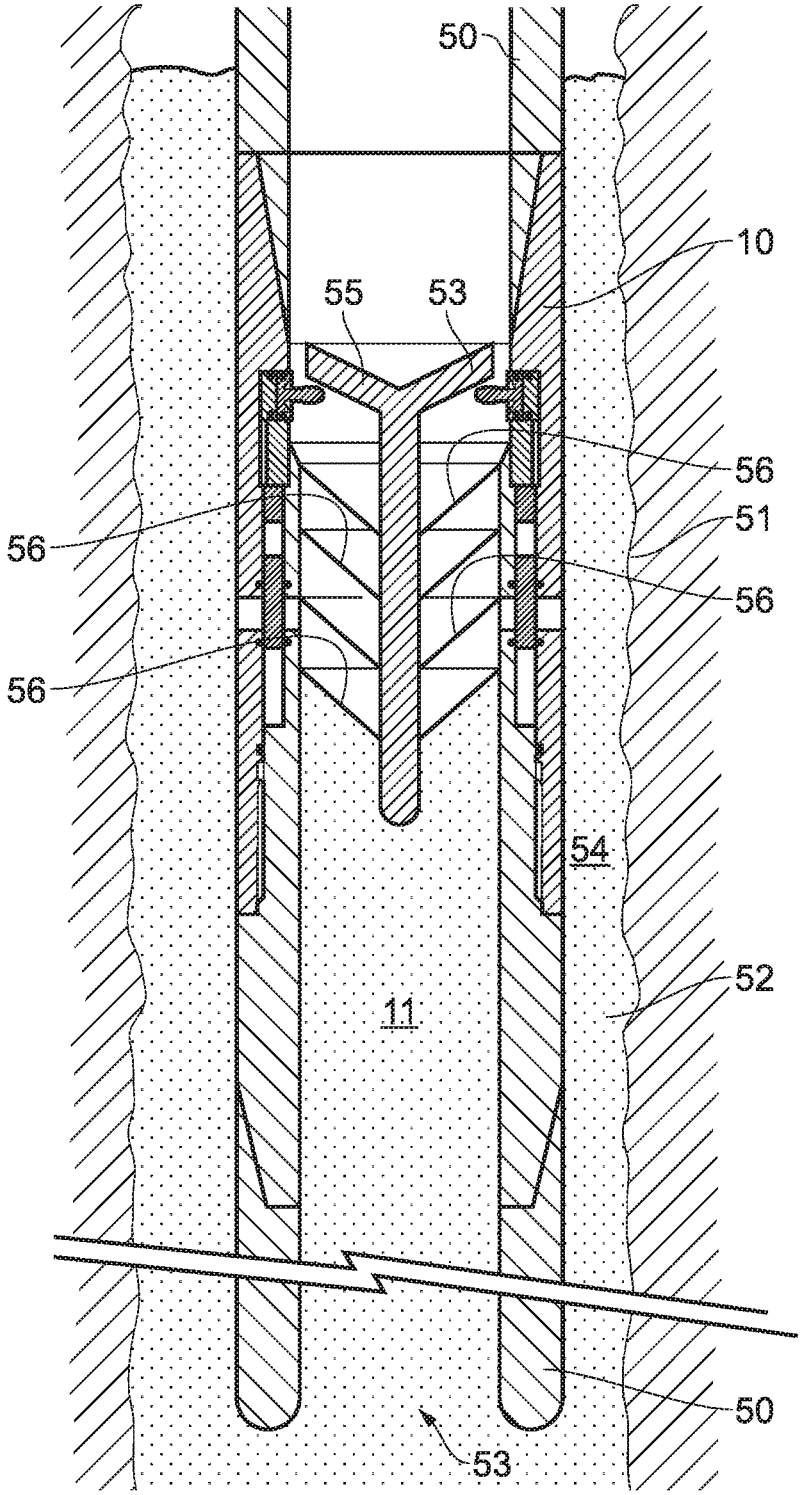
FIG. 2 illustrates parts of a wellbore completion.

Examples of the use of the valve 1 will now be described with reference to FIGS. 1-5. FIG. 2 shows the valve 1 installed as part of a tubular 50 extending into a well 51. During completion, cement 52 is pumped down into the tubular 50, out through and end opening 53 of the tubular 50 and upwards in an annulus 54 between the tubular and the wellbore 51. When a sufficient amount of cement has been provided, a wiper dart 55 (or an equivalent element) is pumped down through the tubular 50. The wiper dart 55 may comprise a set of flexible scraper elements 56, for example rubber elements, and a rigid tail element 57.

Figure 3:
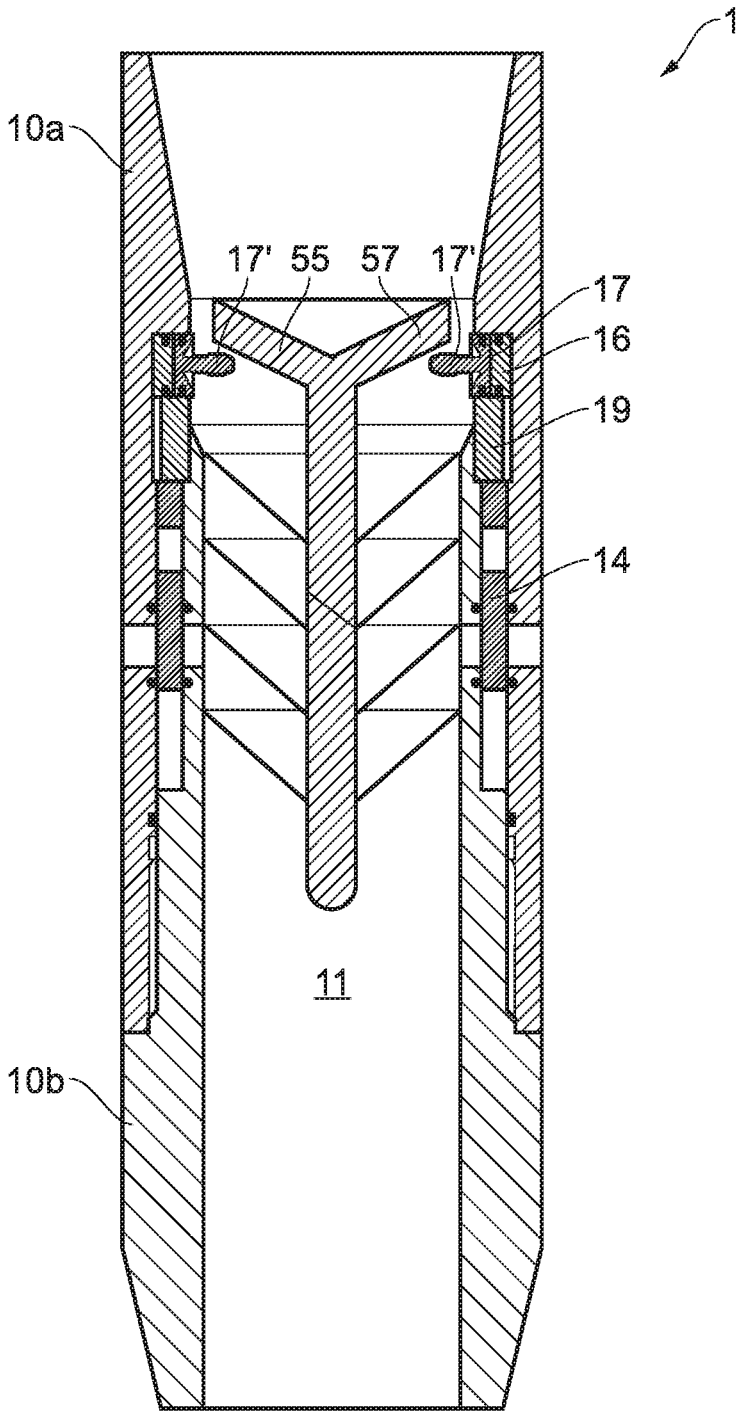
FIGS. 3-5 illustrate the valve shown in FIG. 1 in different operational states.
Figure 4:
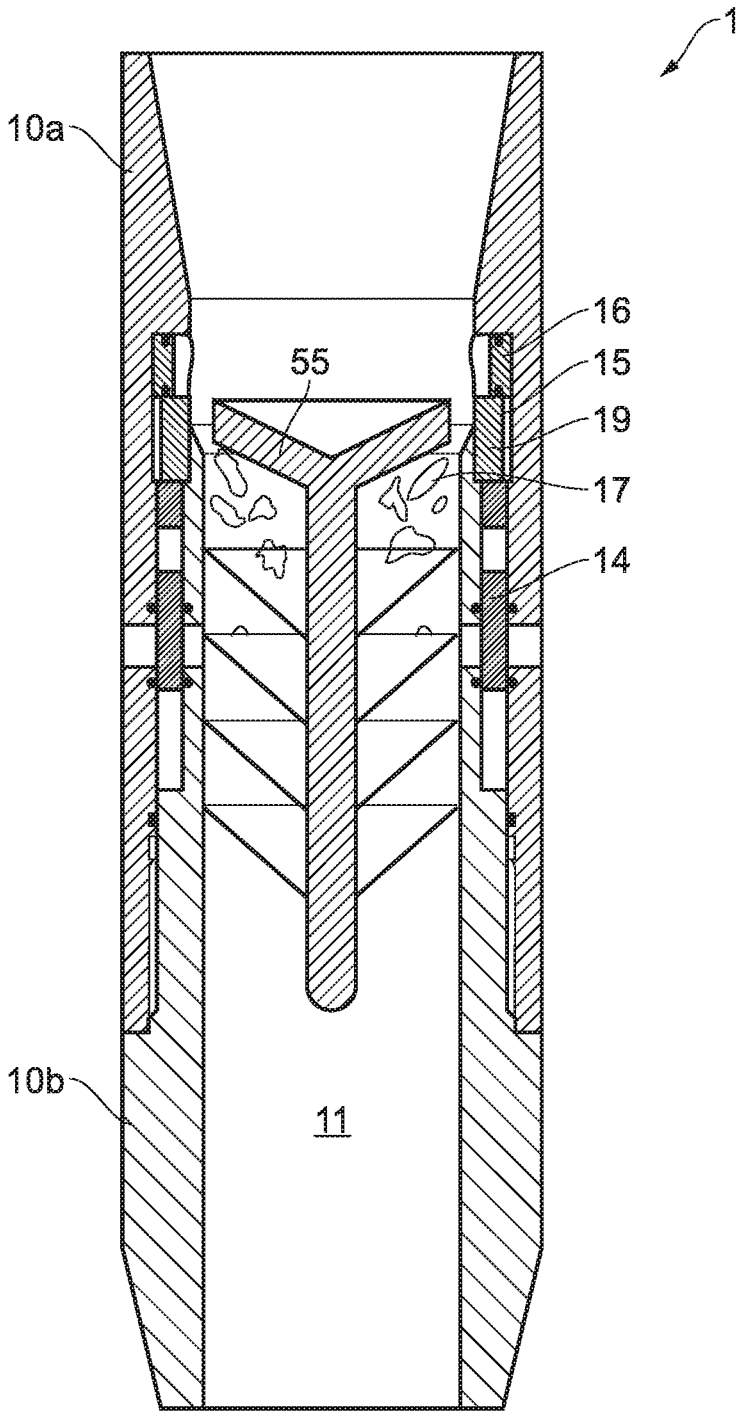
Figure 5:
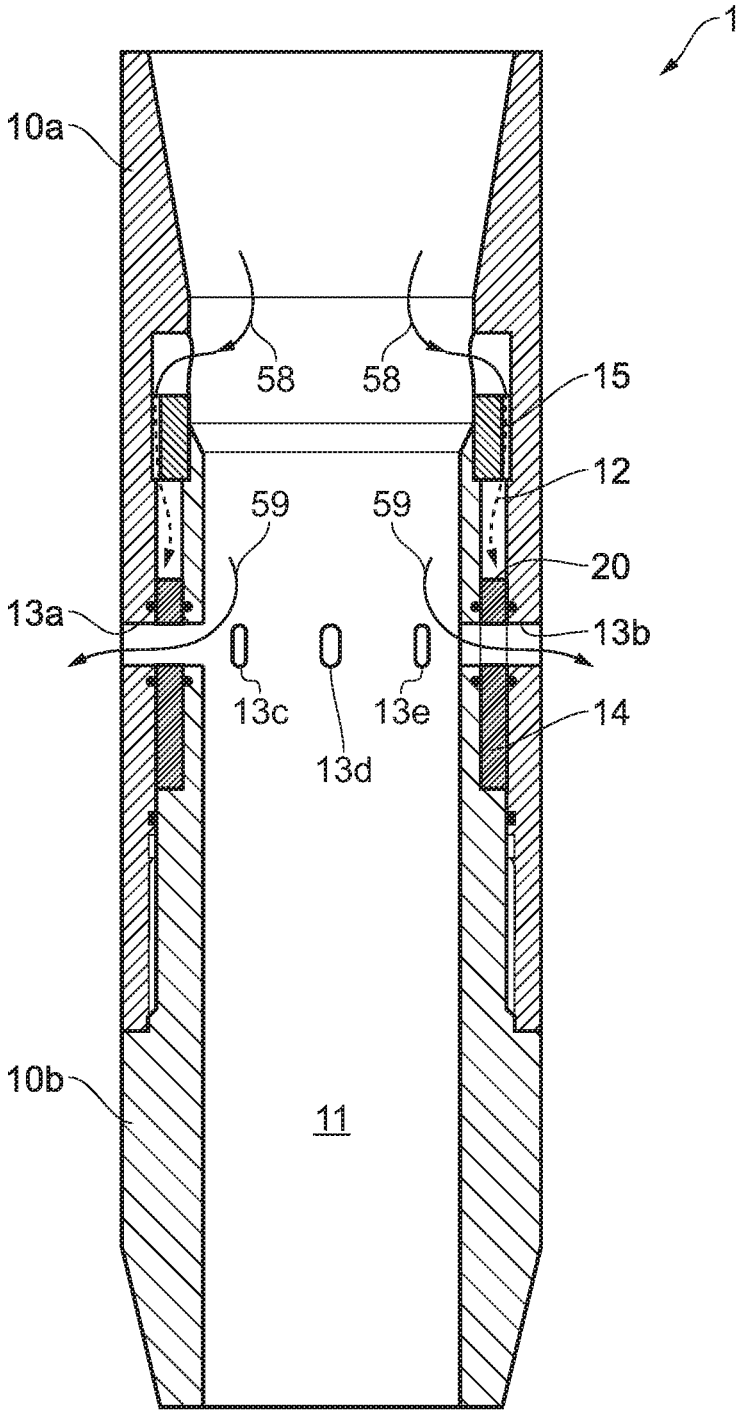

Referring now to FIG. 3, which depicts the same situation as in FIG. 2. As the wiper dart 55 reaches the valve 1, the tail end 57 will engage the protruding part 17' of the protective plug 17. As the protective plug 17 is made of a brittle material, it will break under the impact of the wiper dart 55 and the downwards force acting on the protruding part 17'. As the protective plug 17 breaks, illustrated in FIG. 4, the dissolvable plug 16 is exposed to the fluids in the main passage 11, i.e. the fluids pumped down through the tubular 50. The dissolvable plug 16 is reactive to this fluid, and starts to dissolve and disintegrate. The speed at which this happens may vary depending on the type of material used and the type(s) of fluid present in the main passage 11, however eventually the fluid channel 15 is freed. When this happens, fluid in the main passage 11 is free to flow through the fluid channel 15 and to the chamber 12, as illustrated by arrows 58 in FIG. 5. By pressurizing the tubular 50, the pressure of the fluid in the main passage 11 will thus act on the pressure face 20 of the sleeve 14, and drive the sleeve towards the open position. Fluid can then be pumped through the tubular 50 and out through the ports 13*a-e*, as illustrated by arrows 59, for example for fracturing the formation.

Figure 6:
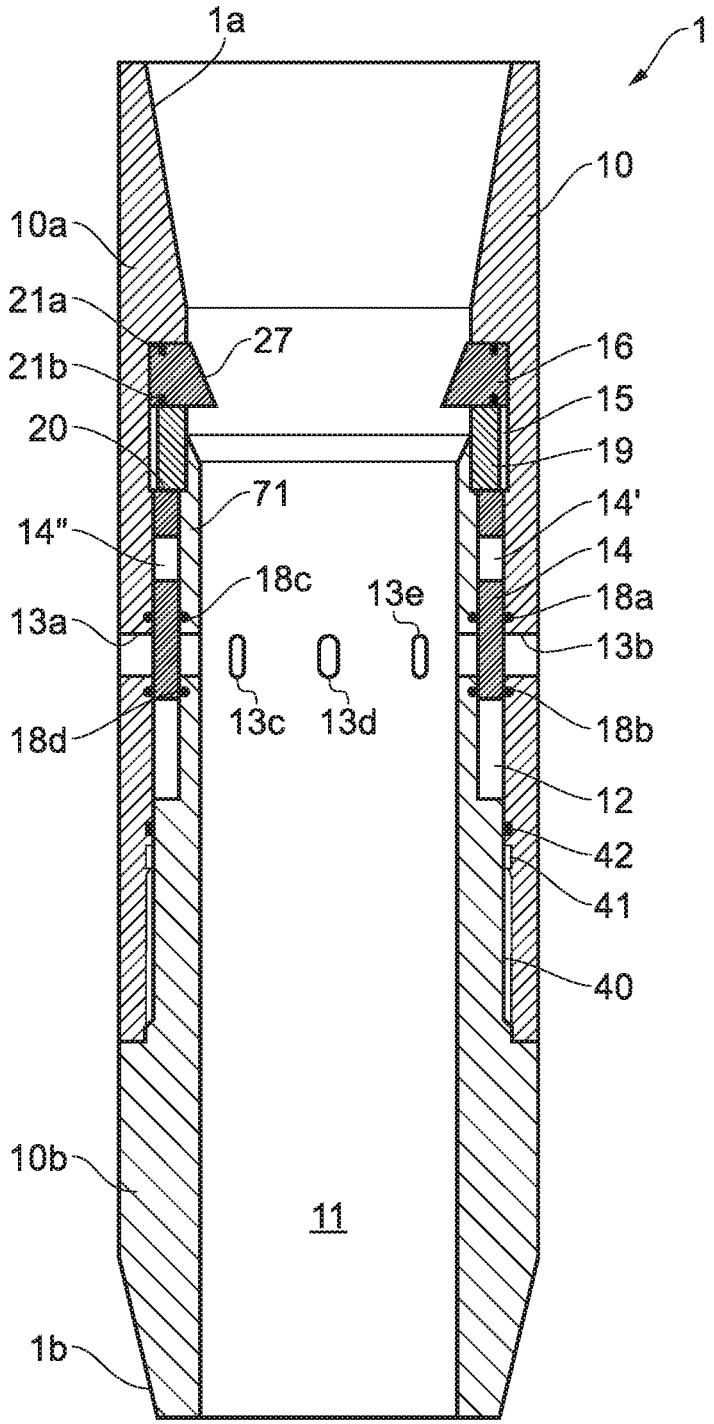
FIG. 6 illustrates a valve according to an embodiment.

In an embodiment, illustrated in FIG. 6, the protective element is a coating 27 applied on at least a part of the dissolvable plug 16. The coating 27 may, for example, only be applied on the side which, prior to activation, is exposed to the fluids in the main passage 11, or, alternatively, it can be applied to the entire dissolvable plug 16.

The coating or layer may be, for example, DLC (diamond-like-carbon), PVD (physical vapor deposition), EBPVD (electron beam physical vapor deposition), powder coating with thermosets and or thermoplastics, TSC (thermal spray coating), HVOF (high velocity oxy-fuel coating), shrouded plasma-arc spray coating, plasma-arc spray coating, electric-arc spray coating, flame spray coating, cold spray coating, epoxy coatings, plating including HDG (hot-dip galvanizing), mechanical plating, electro plating, non-electric plating method, all of which can be done with metals such as chromium, gold, silver, copper or other applicable metal; paints and other organic coatings, ceramic polymer coatings, nano ceramic particles or other nano particle coatings, rubber coatings, plastic coating, vapor phase corrosion inhibitor (VpCI®) technology or xylan coatings.

Activation of the valve 1 in this embodiment can be done by passing a rupture element down into the tubular 50. For example, a rupture ball comprising pins or studs can be used. Alternatively, the wiper dart 55 may comprise such rupture elements. When the rupture elements engages the dissolvable plug 16, the coating 27 is damaged and the dissolvable material is exposed to the fluids in the main passage 11. The plug 16 thus starts to dissolve, which leads to activation of the valve 1 in a similar manner as described in relation to FIGS. 1-5.

As illustrated in FIG. 6, a part of the dissolvable plug 16 which comprises the coating 27 may protrude into the main passage 11. This may ease the activation of the valve 1 with a rupture element. Alternatively, the coating can be damaged by other means, such as a dedicated tool therefor. The protective coating can also be of a type that is for instance removed or damaged by abrasion from the cement pumped past the dissolvable plug. In that way, the plug can, for example, be mounted flush with the inner walls of the valve 1.

Figure 7:
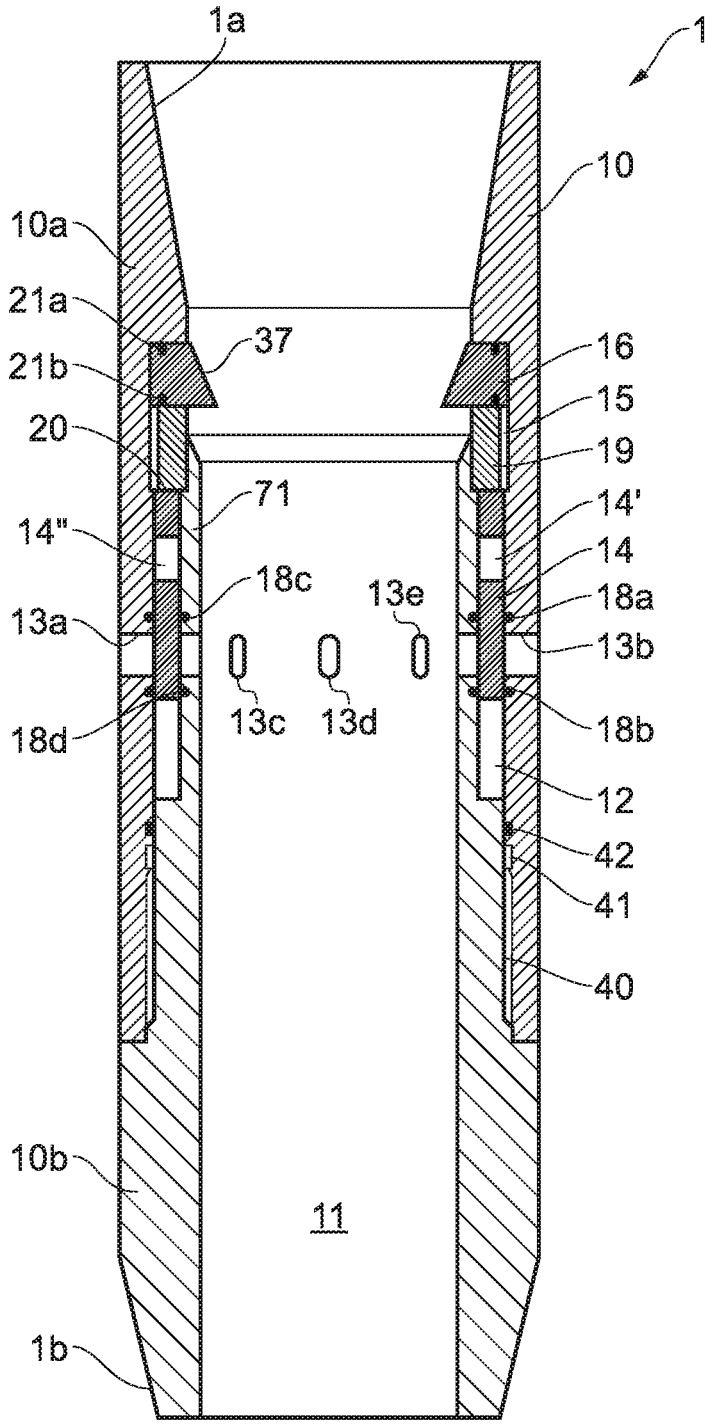
FIG. 7 illustrates a valve according to an embodiment.

In an embodiment, illustrated in FIG. 7, the protective element is a protective cover 37 covering at least a part of the dissolvable plug 16. The cover 37 may, for example, be applied to cover the front of the dissolvable plug 16. The protective cover 37 may be, for example, a material comprising rubber, plastic, glass, ceramics or another type of material.

Activation of the valve may be done in a similar manner as described above, with a rupture element, or with a dedicated tool therefor, to damage, remove or destroy the protective cover 37 and start dissolving of the plug 16.

In certain embodiments the protective element 17, 27, 37 thus need not protrude into the main passage. In such an case, the protective element 17, 27, 37 may be removed and/or ruptured by a dedicated tool. This may, for example, be a tool lowered into the tubular by wireline operation. In this case, the risk that the protective element 17, 27, 37 is accidentally ruptured or removed prior to the desired activation time is reduced.

Figure 8:
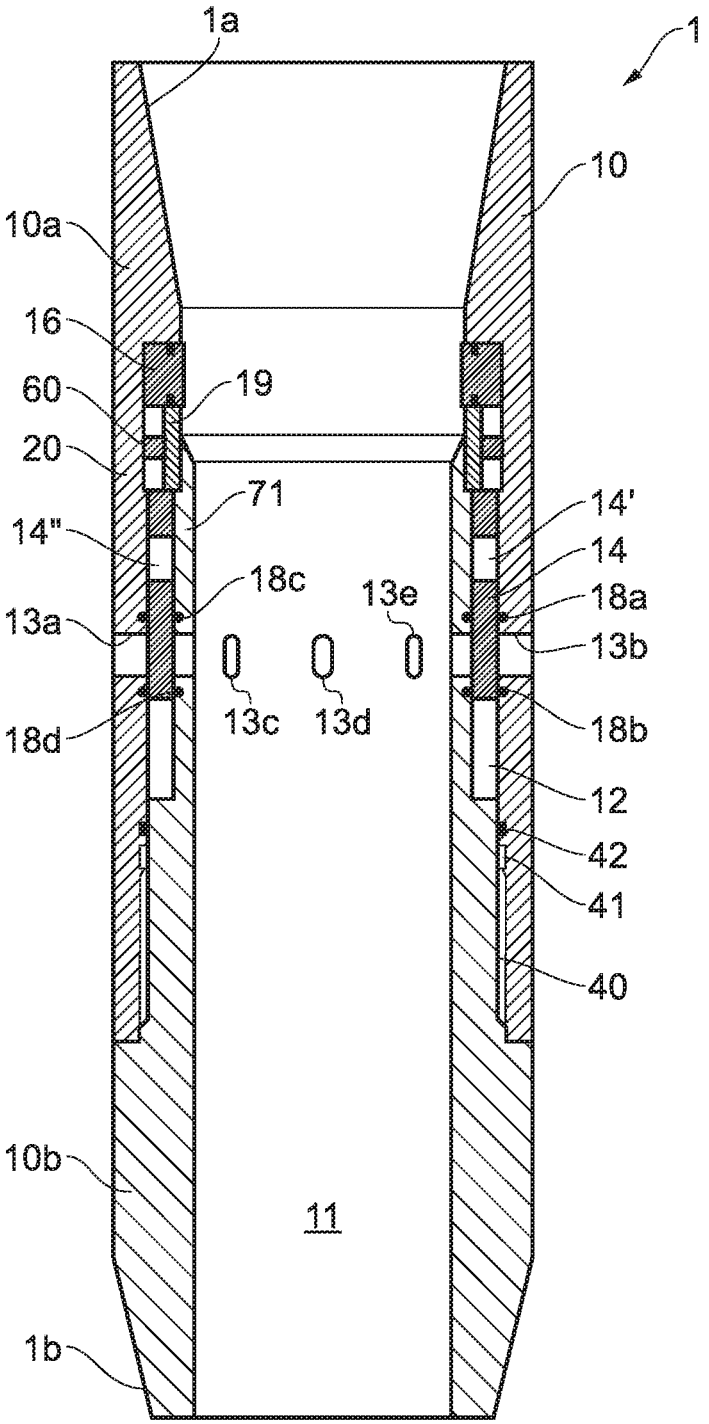
FIG. 8 illustrates a valve according to an embodiment.

In an embodiment, illustrated in FIG. 8, the valve 1 comprises a breakable fluid barrier 60 arranged in the fluid channel 15 and a dissolvable plug 16 also arranged in the fluid channel 15. The breakable fluid barrier 60 is arranged between the dissolvable plug 16 and the annular chamber 12, and may be, for example, a rupture disc made for example of glass or another brittle material, a check valve, a pressure relief valve, or any other element capable of being opened, ruptured or removed under the influence of fluid pressure.

In the embodiment shown in FIG. 8, the dissolvable plug 16 does not have a protective element. This will lead to the plug 16 starting to dissolve as soon as it comes into contact with fluids in the main passage 11 to which the dissolvable material is reactive. Nevertheless, this may be sufficient in certain applications, still providing sufficient time for, for example, pressure testing of the completion while the dissolvable plug 16 is still intact, and before activation of the valve 1.

Alternatively, the dissolvable plug 16 may be arranged with a protective element according to one of the embodiments described above, or of a different type.

By having a breakable fluid barrier 60, the activation of the valve 1 can be better controlled, in that a minimum pressure is required to be applied to the tubular 50 before the valve 1 is activated. By means of the dissolvable plug 16, the pressure setting (for breakage) of the dissolvable plug 16 can be lower than the completion test pressure, thereby allowing pressure testing of the well to a high pressure while subsequently allowing pressure-induced activation of the valve without compromising well integrity.

Figure 9:
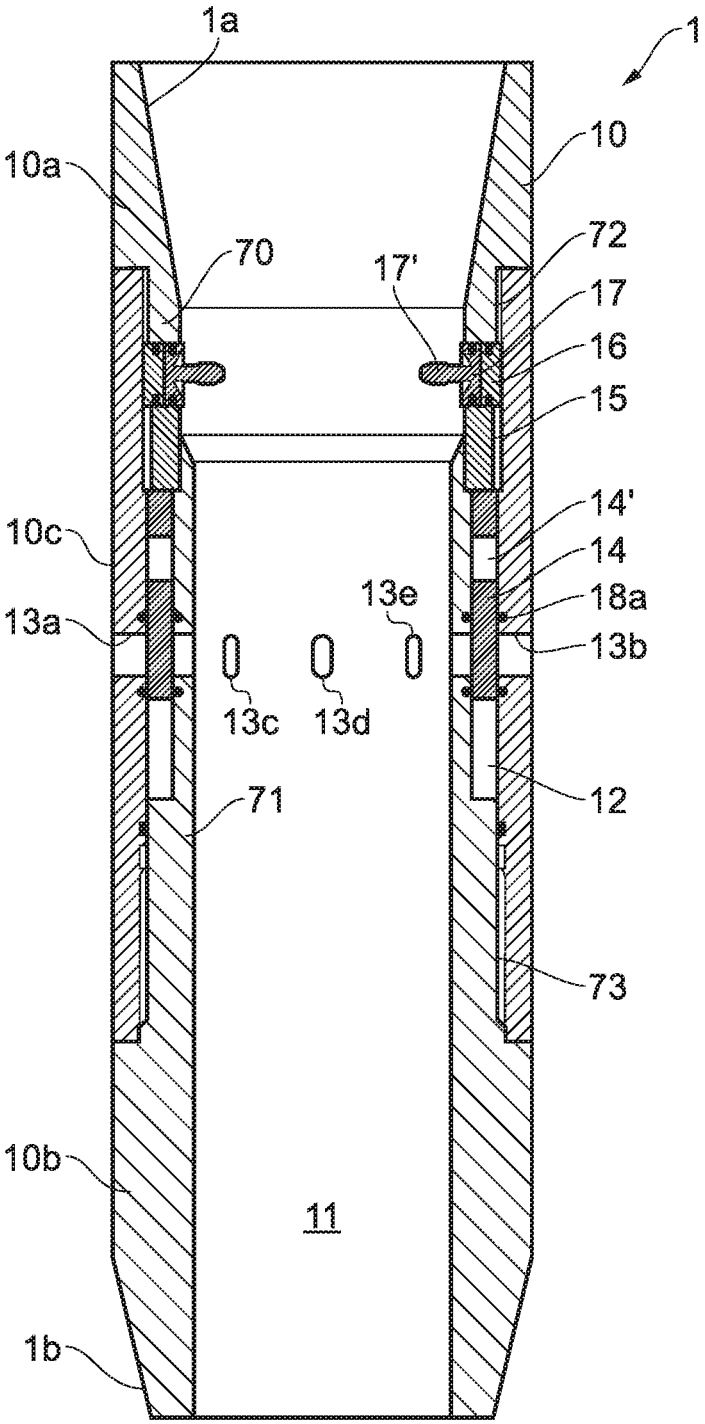
FIG. 9 illustrates a valve according to an embodiment.

In an embodiment, shown in FIG. 9, the valve body 10 is made up of a first sub 10*a* defining a first part of the throughbore 11, a second sub 10*b* defining a second part of the throughbore 11, and a housing 10*c* mechanically connecting the first sub 10*a* and the second sub 10*b*. The valve 1 shown in FIG. 9 is otherwise equivalent to that shown in FIG. 1, however any of the embodiments described herein may be arranged with a valve body 10 having a first sub 10*a*, a second sub 10*b* and a housing 10*c* equivalent to that shown in FIG. 9.

At least two of the first sub 10*a*, the second sub 10*b* and the housing 10*c* define the annular chamber 12 between them, in which the sleeve 14 is arranged. The valve ports 13*a-e* extend radially through the housing 10*c* and through at least one of the first sub 10*a* and the second sub 10*b*.

In the embodiment shown in FIG. 9, the first sub 10*a* has a protruding portion 70 at a part of the first sub 10*a* which is opposite the end section 1*a*. Similarly, the second sub 10*b* has a protruding portion 71 at a part of the second sub 10*b* which is opposite the end section 1*b*. Connection means 72,73, for example a threaded portion, is provided at an outer circumference of each protruding portion 70,71.

The housing 1*c* in this embodiment is generally of an elongate, hollow cylindrical form and near its upper and lower ends the housing 1*c* has connection means at its inner circumference to cooperate with the connection means 72,73. In the embodiment shown, threaded connections connect the first sub 10*a* to the upper end of the housing 10*c* and the second sub 10*b* to the lower end of the housing 10*c*.

Figure 10:
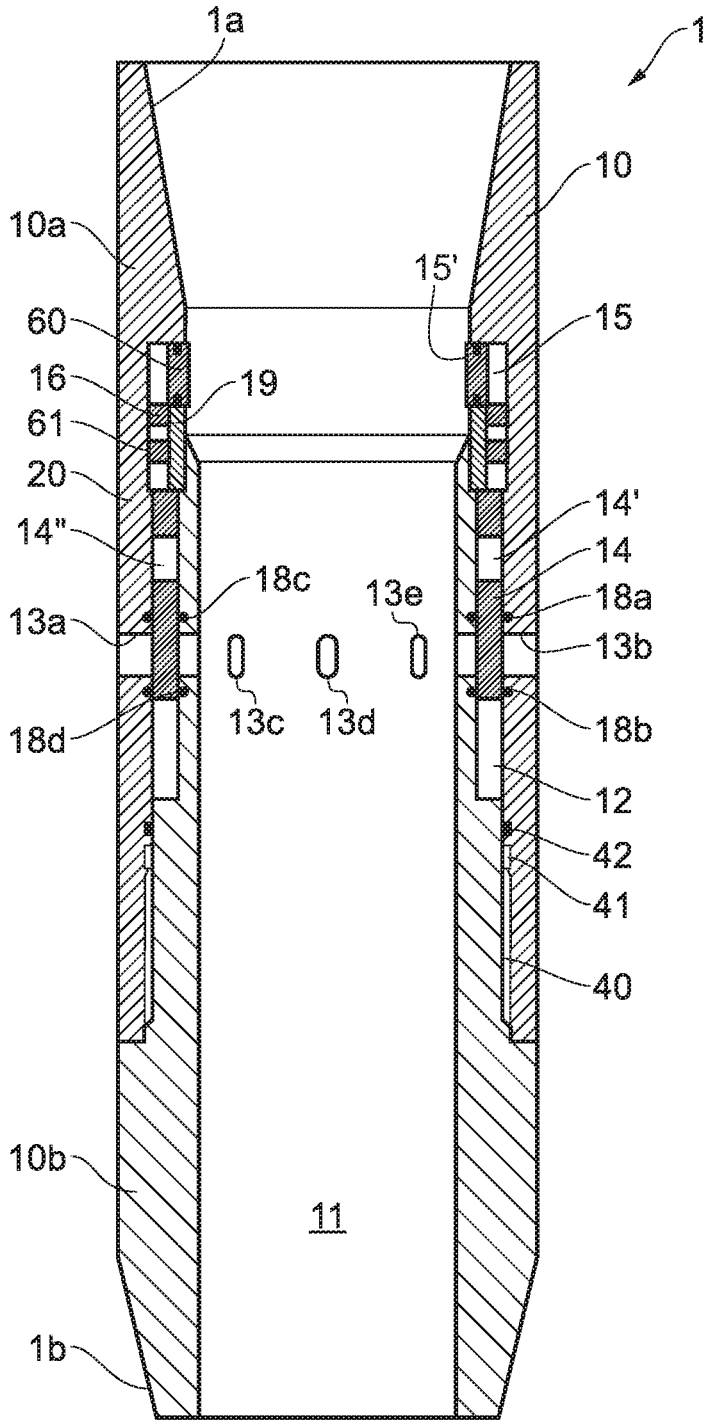
FIG. 10 illustrates a valve according to an embodiment.

In an embodiment, illustrated in FIG. 10, the valve 1 comprises a breakable fluid barrier 60 arranged in the fluid channel 15 and a dissolvable plug 16 also arranged in the fluid channel 15. The dissolvable plug 16 is arranged between the breakable fluid barrier 60 and the annular chamber 12. As described in relation to the embodiments described above, the breakable fluid barrier 60 may, for example, be a rupture disc, a check valve, or a pressure relief valve.

In the embodiment shown in FIG. 10, the dissolvable plug 16 will be protected from the fluids in the main passage 11 until the breakable fluid barrier 60 is removed. (For example, by rupturing it by means of pressurizing the main channel 11 with a fluid pressure higher than the rupture pressure of the breakable fluid barrier 60.)

The pressure at which the breakable fluid barrier 60 is configured to break or open may be lower than a test pressure applied to test the completion. In this embodiment, it is for example possible to complete the well, including running the tubular and cementing it, and returning at a later time to activate the valve 1 to prepare for/commence production. (Which may, for example, include fracturing the formation.) Pressure testing the completion will then break the breakable fluid barrier 60, however the dissolvable plug 16 will prevent the valve 1 from activating until the plug 16 has dissolved. This thereby provides time for pressure testing without the valve 1 opening. Subsequently, when the dissolvable plug 16 has dissolved and freed the fluid channel 15, the tubular 50 and thereby the main passage 11 can be pressurized to move the sleeve 14 and open the valve 1.

Optionally, the valve 1 may comprise a second breakable fluid barrier 61, also shown in FIG. 10. The second breakable fluid barrier 61 is arranged between the dissolvable plug 16 and the annular chamber 12. The second breakable fluid barrier 61 may be configured to break at a lower pressure than the first breakable fluid barrier 60. In this embodiment, the well may be completed and the completion be pressure tested, resulting in the first breakable fluid barrier 60 opening. The dissolvable plug 16 will, however, block the fluid channel 15 during the pressure testing of the completion. Subsequently, when the dissolvable plug 16 has freed the fluid channel 15, the tubular 50 and thus the main passage 11 can be pressurized up to a pressure required to break the second breakable fluid barrier 61, whereby the valve 1 can be opened. This embodiment may be advantageous, for example, if a there is a prolonged time period between the well completion/testing and the desired activation of the valve 1 and commencement of production from the well. In this time period, the fluid channel 15 will thus be blocked by the second breakable fluid barrier 61. The dissolvable plug 16 will in such cases prevent the valve 1 from opening prematurely during the initial pressure test of the well by protecting the second fluid barrier 61 from seeing the initial test pressure. The tubing can thereby be pressure tested to the full working pressure without the risk of opening the valve 1 prematurely, and the risk of overpressuring the tubing, casing or well completion is minimized.

In an embodiment there is provided a downhole tool 1 having a body 10; an activation element 12,14 arranged within the body 10; a fluid channel 15,15*a,b* extending from an opening 15',15*a'*,15*b'* in the body 10 to the activation element 12,14; at least one dissolvable plug 16,16*a-c* sealingly arranged in the fluid channel 15; and at least one breakable fluid barrier 60,60*a-c* sealingly arranged in the fluid channel 15.

Figure 11:
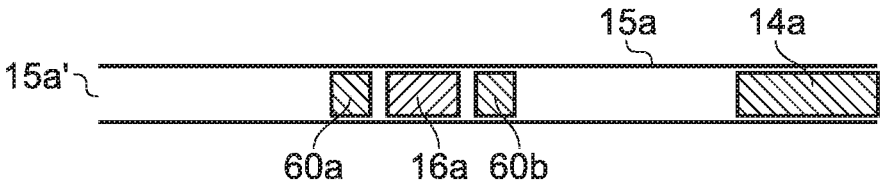
FIG. 11 illustrates aspects of a tool according to an embodiment.
Figure 11:
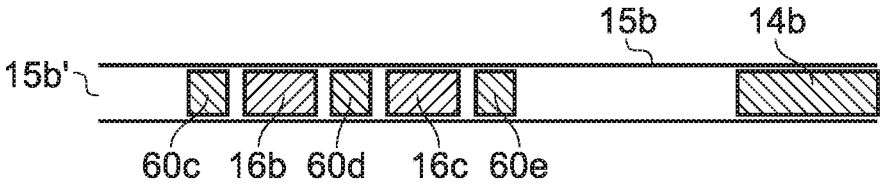

FIG. 10 illustrates a tool 1 according to this embodiment, in this case being a valve 1, however the tool 1 may be any type of downhole tool. FIG. 11 illustrates, schematically, certain aspects of alternative embodiments of the tool 1.

In a tool according to an embodiment, using, for example, one or more burst discs 60*a-e* and one or more dissolvable plugs 16*a-c* in the fluid channel 15, the tool can effectively be set up with a "counter system". By using several dissolvable plugs sandwiched between breakable fluid barriers in a row, the tool can be set up to require a given number of pressure cycles before it activates. For example, with reference to FIG. 11(*a*), having a first breakable fluid barrier 60*a* in the fluid channel 15*a*, followed by a dissolvable plug 16*a*, followed again by a second breakable fluid barrier 60*b* effectively provides a two-pressure-cycle counter system: during the first pressure cycle the first breakable element is ruptured, but the activation element 14*a* is not pressurized and the tool is not activated due to the plug 16*a*. However, subsequent to the barrier 60*a* being ruptured, the plug 16*a* is exposed to well fluids and starts to dissolve. When the plug 16*a* has freed the fluid path between the opening 15' and the second breakable fluid barrier 60*b*, the well can again be pressurized (in a second pressure cycle) to break the barrier 60*b* and activate the tool via the activation element 14*a*.

Similarly, as shown in FIG. 11(*b*), one can arrange three breakable fluid barriers 60*c-e* and two dissolvable plugs 16*b,c* in a channel 15*b* of a second tool, whereby the second tool then requires three pressure cycles to activate via the activation element 14*b*. Consequently, according to this embodiment, downhole tools can be arranged with different configurations of fluid barriers and plugs such as to activate at different times. This can, for example, be used where different tools arranged in a well completion is to be activated sequentially at different times, where pressurizing the well in cycles from the surface will activate different tools at different times, allowing time for the dissolvable plug(s) to dissolve between the applied pressure cycles. This may include, for example, a series of valves, such as hydraulic fracturing valves, arranged in the tubing string 50.

The activation element may comprise a sleeve 14 slidably arranged in a chamber 12, as illustrated in relation to the valve 1 described above, or the activation element may be of a different type, for example a different type of mechanical activation element, a swellable element or the like.

According to this embodiment, such a "counter system" functionality for controlled activation of downhole tools can be obtained without any mechanical or electronic counter system and with no moving parts required to be engaged by, for example, an activation element passed down into the well. A tool according to this embodiment can thereby provide a less costly system which is less prone to breakdown or failure, for example jamming due to contamination from well fluids.

Examples of downhole tools that can be operated with this type of counter system include, but are not limited to: valves; production packers; downhole barrier plugs; sliding sleeves; cementing equipment; perforation systems; and setting tools. These are only examples of tools, and not meant to be limiting in any way; the skilled person will understand that this counter system can be implemented in virtually any type of downhole tool which requires activation from surface.

In an embodiment, there is provided a tubular assembly 50 for use in a wellbore, comprising a first downhole tool according to any of the embodiments described above and a second downhole tool according to any of the embodiments described above, wherein the first downhole tool has a higher number of dissolvable plugs 16,16*a-c* and a higher number of breakable fluid barriers 60,60*a-e* than the second downhole tool. The first downhole tool and the second downhole tool may be valves according to any of the embodiments described above.

According to certain embodiments described herein, an improved downhole tool is provided. In some embodiments, for example, after cementing and completion, a tool according to embodiments described here may allow more flexibility in pressure testing of the completion before the tool is activated and, for example, hydraulic fracturing operations and well production commence. Testing with high pressures may therefore be performed, without the risk that the tool unintentionally activates under the test pressure. Further, there will be no need to apply a pressure higher than that against which the completion has been pressure tested to activate the tool.

The tool according to certain embodiments described herein further provdes a compact and reliable solution for use as, for example, a toe valve in well completions. The inner diameter in the main passage 11 can be designed to be only minimally smaller than the tubular bore, and the risk that the operation of the valve is interrupted by, for example, cement clogging fluid activation paths is minimised. In certain embodiments there is provided a valve 1 in which the valve body 10 can be made up of fewer components with less machining required, which, for example, eases manufacturing and increases operational reliability. For example, fewer sealing faces reduces the sealing requirements and the risk of leakage, while the structural arrangement reduces the risk of operational failures, for example when the valve 1 is subjected to high compression, tension, or bending forces, as is commonly the case in wellbore completions.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof. In particular, a variety of features associated with a downhole valve 1 have been described in relation to different embodiments. Although individual fetaures may have been described in relation to different embodiments, it is to be understood that each individual feature, or a selection of features, described above may be used or combined with any of the embodiments, to the extent that this is technically feasible.

The present invention is not limited to the embodiments described herein; reference should be had to the appended claims.

The invention claimed is:

1. A downhole valve, comprising:

a valve body with a longitudinal main passage;

an annular chamber arranged in the valve body;

at least one valve port extending from the main passage, through the annular chamber and to an outside of the valve;

a sleeve disposed at least partially within the annular chamber, the sleeve being movable in response to an application of fluid pressure to the annular chamber via a fluid channel extending from the main passage to the annular chamber between a closed position in which the sleeve blocks the at least one valve port and an open position in which the sleeve does not block the at least one valve port;

a dissolvable plug sealingly arranged in the fluid channel;

a protective element arranged to isolate the dissolvable plug from the main passage, wherein the protective element is a coating on at least part of the dissolvable plug.

2. A downhole valve according to claim 1, wherein at least a part of the protective element protrudes into the main passage.

3. A downhole valve according to claim 1, further comprising a breakable fluid barrier arranged in the fluid channel.

4. A downhole valve according to claim 3, wherein the breakable fluid barrier comprises a rupture disc, a check valve, or a pressure relief valve.

5. A downhole valve according to claim 3, wherein the breakable fluid barrier is arranged between the dissolvable plug and the annular chamber.

6. A downhole valve according to claim 3, wherein the dissolvable plug is arranged between the breakable fluid barrier and the annular chamber.

7. A downhole valve according to claim 6, wherein the breakable fluid barrier is a first breakable fluid barrier, and the downhole valve further comprises a second breakable fluid barrier, the second breakable fluid barrier being arranged between the dissolvable plug and the annular chamber.

8. A downhole valve according to claim 7, wherein the second breakable fluid barrier is configured to open at a lower pressure than the first breakable fluid barrier.

9. A downhole valve according to claim 7, wherein the second breakable fluid barrier is configured to open at a lower pressure than the first breakable fluid barrier.

10. A downhole tool comprising:

a body;

an activation element arranged within the body;

a fluid channel extending from an opening in the body to the activation element;

at least one dissolvable plug sealingly arranged in the fluid channel;

a first breakable fluid barrier sealingly arranged in the fluid channel; and a second breakable fluid barrier arranged in the fluid channel at an opposite side of the dissolvable plug from the first breakable fluid barrier.

11. A downhole tool according to claim 10, comprising a plurality of dissolvable plugs sealingly arranged in the fluid channel and a plurality of breakable fluid barriers sealingly arranged in the fluid channel, the dissolvable plugs and the breakable fluid barriers being arranged alternatingly in the fluid channel.

12. A tubular assembly for use in a wellbore, comprising: a first downhole tool, the first downhole tool being a downhole tool according to claim 10; and a second downhole tool, the second downhole tool being a downhole tool according to claim 10; wherein the first downhole tool has a higher number of dissolvable plugs or a higher number of breakable fluid barriers than the second downhole tool.

13. A tubular assembly according to claim 12, wherein the first downhole tool and the second downhole tool are valves.

14. A method of completing a well, comprising:

deploying a tubular comprising a downhole valve according to claim 1 into a wellbore;

pumping cement through the tubular and into an annulus between the tubular and a formation;

causing the dissolvable plug to degrade, disintegrate or dissolve;

actuating the downhole valve by applying a fluid pressure to the annular chamber via the fluid channel; and flowing a fluid through the at least one valve port.

15. A method according to claim 14, wherein the step of actuating the valve comprises removing or damaging a protective element arranged to isolate the dissolvable plug from the main passage.

16. A downhole valve, comprising:

a valve body with a longitudinal main passage;

an annular chamber arranged in the valve body;

at least one valve port extending from the main passage, through the annular chamber and to an outside of the valve;

a sleeve disposed at least partially within the annular chamber, the sleeve being movable in response to an application of fluid pressure to the annular chamber via a fluid channel extending from the main passage to the annular chamber between a closed position in which the sleeve blocks the at least one valve port and an open position in which the sleeve does not block the at least one valve port;

a dissolvable plug sealingly arranged in the fluid channel;

a protective element arranged to isolate the dissolvable plug from the main passage, wherein the protective element is a protective cover arranged to cover at least part of the dissolvable plug.

17. A downhole valve according to claim 16, wherein the protective cover at least partly comprises a rubber material, a plastic material, a ceramic material or a glass material.

18. A downhole valve according to claim 16, wherein at least a part of the protective element protrudes into the main passage.

19. A downhole valve according to claim 16, further comprising a breakable fluid barrier arranged in the fluid channel.

20. A downhole valve according to claim 18, wherein the breakable fluid barrier comprises a rupture disc, a check valve, or a pressure relief valve.

21. A downhole valve according to claim 18, wherein the breakable fluid barrier is arranged between the dissolvable plug and the annular chamber.

22. A downhole valve according to claim 18, wherein the dissolvable plug is arranged between the breakable fluid barrier and the annular chamber.

23. A downhole valve according to claim 21, wherein the breakable fluid barrier is a first breakable fluid barrier, and the downhole valve further comprises a second breakable fluid barrier, the second breakable fluid barrier being arranged between the dissolvable plug and the annular chamber.

* * * * *